US005113935A

United States Patent [19]

Jones et al.

[11] Patent Number: 5,113,935

[45] Date of Patent: May 19, 1992

[54] GRAVEL PACKING OF WELLS

[75] Inventors: Lloyd G. Jones, Dallas; Charles S. Yeh, Plano, both of Tex.

[73] Assignee: Mobil Oil Corporation, Fairfax, Va.

[21] Appl. No.: 694,163

[22] Filed: May 1, 1991

[51] Int. Cl.[5] ..... E21B 43/04; E21B 43/08

[52] U.S. Cl. ..... 166/51; 166/278

[58] Field of Search ..... 166/51, 278, 276, 227, 166/233, 205

[56] References Cited

U.S. PATENT DOCUMENTS 2,014,770 9/1935 Layne ..... 166/51
4,393,932 7/1983 Bodine ..... 166/51 X
4,558,742 12/1985 Huang et al. ..... 166/51 X
4,646,839 3/1987 Rickey ..... 166/51 X
4,945,991 8/1990 Jones ..... 166/51 X

*Primary Examiner*—Stephen J. Novosad
*Attorney, Agent, or Firm*—Alexander J. McKillop; Charles J. Speciale; George W. Hager, Jr.

[57] ABSTRACT

Apparatus for gravel packing a wellbore interval having shunt means (i.e. conduits) on the external surface of a sand screen which can selectively deliver a gravel slurry to different levels of the interval during operation. The shunt means is comprised of a variety of differently configured, perforated conduits and/or arrangements of these conduits.

8 Claims, 2 Drawing Sheets

GRAVEL PACKING OF WELLS

1. TECHNICAL FIELD

The present invention relates to the gravel packing of wells and in one of its aspects relates to an apparatus for use in gravel packing a well which provides a good distribution of gravel throughout the packed interval of the wellbore.

2. BACKGROUND

In producing hydrocarbons or the like from loosely or unconsolidated and/or fractured subterranean formations, it is not uncommon to produce large volumes of particulate material (e.g. sand) along with the formation fluids. These particulates routinely cause a variety of problems which result in added expense and substantial downtime. For example, in most instances, particulates in the produced fluids cause (1) severe errosion of the well tubing and other production equipment; (2) partial or complete clogging of the flow from the well which requires workover of the well; (3) caving in the formation and collapse of the well casing; (4) extra processing of the fluids at the surface to remove the particulates; and (5) extra cost in disposing of the particulates once they have been separated. Accordingly, it is extremely important to control the production of particulates in most operations.

Probably the most widely-used technique used to control the production of particulates (e.g. sand) from a well is known as gravel packing. In a typical gravel pack, a screen is lowered into the wellbore and positioned adjacent the interval of the well which is to be completed. Particulate material, collectively referred to as gravel, is then pumped as a slurry down the tubing on which the screen is suspended. The slurry exits the tubing above the screen through a "cross-over" or the like and flows downward in the annulus formed between the screen and the well casing or open hole, as the case may be. The liquid in the slurry flows into the formation and/or the openings in the screen which are sized to prevent the gravel from flowing therethrough. This results in the gravel being deposited or "screened out" in the annulus around the screen where it collects to form the gravel pack. The gravel is sized so that it forms a permeable mass around the screen which allows flow of the produced fluids therethrough and into the screen while blocking the flow any particulates produced with the formation fluids.

One of the major problems associated with gravel packing, especially where long or inclined intervals are to be completed, arises from the difficulty in distributing the gravel over the entire interval to be completed, i.e. completely packing the annulus between the screen and the casing in cased wells or between the screen and the wellbore in open hole or under-reamed completions. This poor distribution of gravel (i.e. incomplete packing of the interval) is often caused by the liquid in the gravel slurry being lost into the more permeable portions of the formation interval which, in turn, causes the formation of gravel (e.g. sand) "bridges" in the annulus before all of the gravel has been placed. Such bridges block further flow of the slurry through the annulus which prevents the placement of sufficient gravel (a) below the bridge for top-to-bottom packing operations or (b) above the bridge, for bottom-to-top packing operations.

U.S. Pat. No. 4,945,991 discloses a method for gravel packing an interval of a wellbore wherein there is good distribution of the gravel throughout the desired interval even if sand bridges form before all the gravel is deposited. In this method, perforated shunts or conduits are provided along the external surface of the screen which are in fluid communication with the gravel slurry as it enters the annulus in the wellbore adjacent the screen. If a sand bridge forms before all of the gravel is placed, the slurry will flow through the conduits and out into the annulus through the perforations in the conduits to complete the filling of the annulus above and/or below the bridge. In some instances, valve-like devices are provided for the perforations in these conduits so that there is no flow of slurry through the conduits until a bridge is actually formed in the annulus; see co-pending U.S. Pat. application No. 07/648,061, filed Jan. 31, 1991 and assigned to the present Assignee.

SUMMARY OF THE INVENTION

The present invention provides an apparatus for gravel packing an interval of a wellbore wherein there is a good distribution of gravel over the entire interval even if a sand bridge or the like is formed in the interval before the placement of the gravel is completed. The present apparatus is similar to that disclosed in U.S. Pat. No. 4,945,991 but includes shunt means (i.e. conduits and arrangement of conduits) on the external surface of the sand screen which can selectively deliver the gravel slurry to different levels of the interval during the gravel pack operation. This is believed to improve the efficiency of the gravel pack in some applications (e.g. completion of extra long intervals) over that guaranteed with uniform shunts.

More specifically, the present apparatus is comprised of a sand screen (e.g. screens, screened pipes, slotted liners, prepacked screens, etc.) having a cross-over sub or the like attached at its upper end which, in turn, is connected to and suspended in the wellbore by a workstring or tubing string. A shunt means is secured or otherwise provided on the external surface of the screen for selectively delivering a gravel slurry to different levels within the interval of the wellbore being completed. The shunt means of the present invention is comprised of a variety of differently configured, perforated conduits and/or arrangements of these conduits which are adapted to receive the gravel slurry as it reaches the apparatus and direct it to a different levels within the interval. In some embodiments of the present invention, the conduits are open to receive slurry as it flows into the interval while in others the conduits are manifolded together and are connected to the outlet ports in the cross-over so that the slurry flows directly into the conduits for distribution in the interval.

The shunt means of the present invention include (1) a plurality of perforated conduits of different lengths, (2) a plurality of conduits, each of which is perforated along a length which is different from the perforated lengths of the other conduits; (3) at least one perforated conduit wherein the perforations at one end are larger than the perforations at the other end; (4) at least one perforated conduit having a diameter at one end larger than the diameter at the other end; and (5) combinations thereof. Further, some of the conduits can be manifolded together into a first manifold which, in turn, is connected to the outlet ports of the cross-over sub with the first manifold being connected to a second manifold which also has additional conduits connected thereto.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
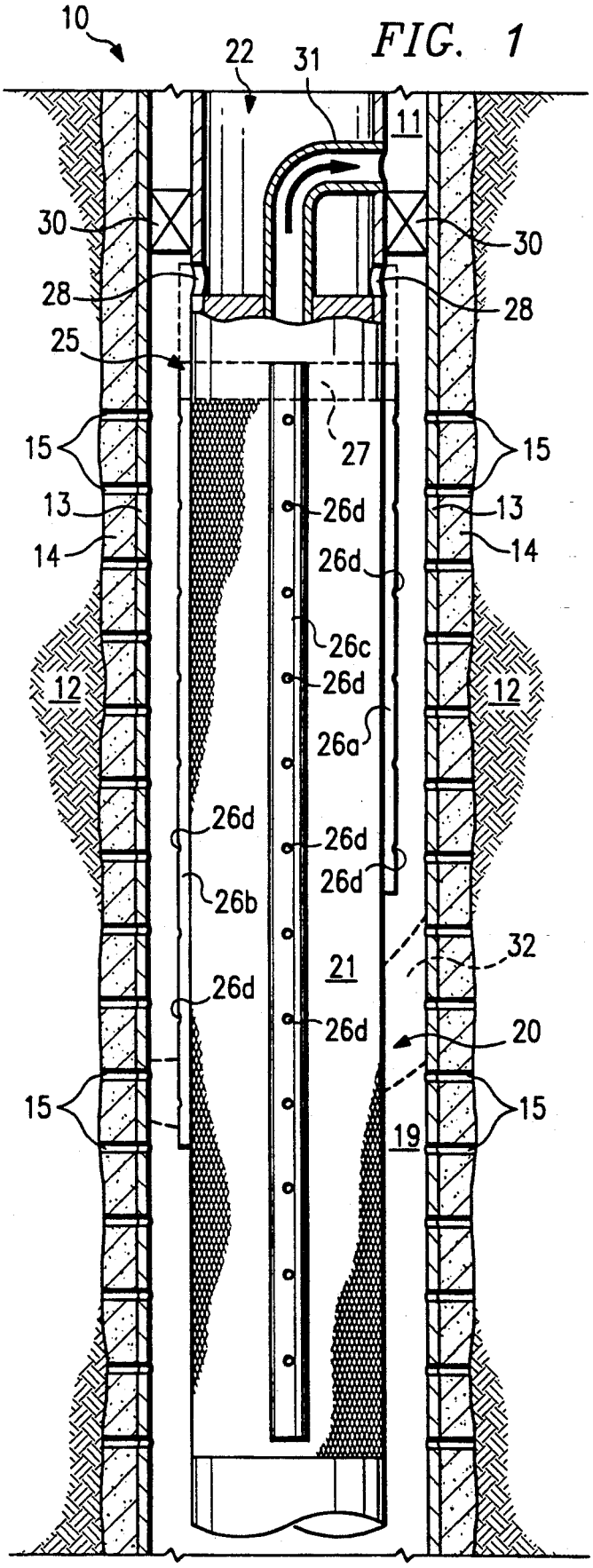
FIG. 1 is an elevational view, partly in section, of the gravel pack apparatus of the present invention in position within a wellbore.

Referring more particularly to the drawings, FIG. 1 illustrates the lower end of a producing and/or injection well 10. Well 10 has a wellbore 11 which extends from the surface (not shown) through an unconsolidated and/or fractured production and/or injection formation 12. As shown, wellbore 11 is cased with casing 13 and cement 14 having perforations 15 therethrough to establish fluid communication between formation 12 and the interior of casing 13. While well 10 is illustrated as a substantially vertical cased well, it should be recognized that the present invention is equally applicable for use in open-hole and/or underreamed completions as well as in horizontal and/or inclined wellbores.

Gravel pack apparatus 20 of the present invention is positioned within wellbore 11 adjacent the completion interval of formation 12 and forms annulus 19 between the screen and the casing 13. Apparatus 20 is comprised of a sand screen 21 having a "cross-over" sub 22 connected to its upper end which, in turn, is suspended from the surface on a tubing or work string (not shown). The term "screen" is used generically herein and is meant to include and cover all types of those structures commonly used by the industry in gravel pack operations which permit flow of fluids therethrough while blocking the flow of particulates (e.g. commercially-available screens, slotted or perforated liners or pipes, screened pipes, prepacked screens and/or liners, or combinations thereof). Screen 21 can be of one continuous length or it may consist of sections (e.g. 30 foot sections) connected together by subs or blanks. An example of a typical sand screen which can be used in the present invention is disclosed in U.S. Pat. No. 4,664,191, issued on May 12, 1987 and is incorporated herein by reference.

Shunt means 25 is mounted or otherwise provided on the external surface of screen 21. As shown in FIG. 1, shunt means, 25 is comprised of a plurality of perforated conduits 26*a–c* of varying lengths which extend longitudinally along the external surface of screen 21; e.g. 26*a* is shorter than 26*b*, 26*b* is shorter than 26*c*, etc.. By varying the lengths of the conduits, gravel slurry flowing through a respective conduit will be selectively delivered through the perforations or openings 26*d* in that conduit to different levels within annulus 19 during the gravel packing operation. Where the interval lies in a horizontal wellbore or the like, "level" is intended to refer to lateral positions within the wellbore. The conduits 26*a–c* can be opened at both ends or open at its top end to receive gravel slurry as will be further explained below. Further, as shown by the dotted lines in FIG. 1, all of the conduits can be manifolded together by a manifold 27 which, in turn, is directly connected to outlet ports 28 in cross-over sub 22 whereby the gravel slurry flows directly into the manifold 27 during a gravel pack operation.

In operation, apparatus 20 is lowered into wellbore 11 on a workstring and is positioned adjacent formation 12. Packer 30 is set as will be understood by those skilled in the art. Gravel slurry is then pumped down the workstring and out the outlet ports 28 in cross-over sub 22. If conduits 26*a–c* are open at their upper ends, the slurry will flow downward in the annulus 19. As the slurry loses liquid to either formation 12 through casing perforations 15 or through screen 21 to be returned through pipe 31 in cross-over 22, the gravel carried by the slurry is deposited and collects in the annulus to form the gravel pack.

As fully explained in U.S. Pat. No. 4,945,991, which is incorporated herein by reference, if the liquid is lost to a permeable stratum in formation 12 before the annulus is filled, a sand bridge (dotted lines 32 in FIG. 1) is likely to form which will block flow through the annulus and prevent further filling below the bridge. If this occurs, the gravel slurry will flow through the perforations 26*d* in the appropriate shunt conduit 26 to finish filling annulus 19.

If conduits 26*a–c* are directly connected to outlet ports 28 by manifold 27, then the entire filling of annulus will be carried out through the perforations in the respective conduits 26*a–c*. Again, by selectively delivering the gravel directly to the various levels in the annulus, it is believed that a better distribution of gravel will be accomplished and a better overall gravel pack efficiency will be obtained in certain applications such as those where long intervals are being completed.

Figure 2:
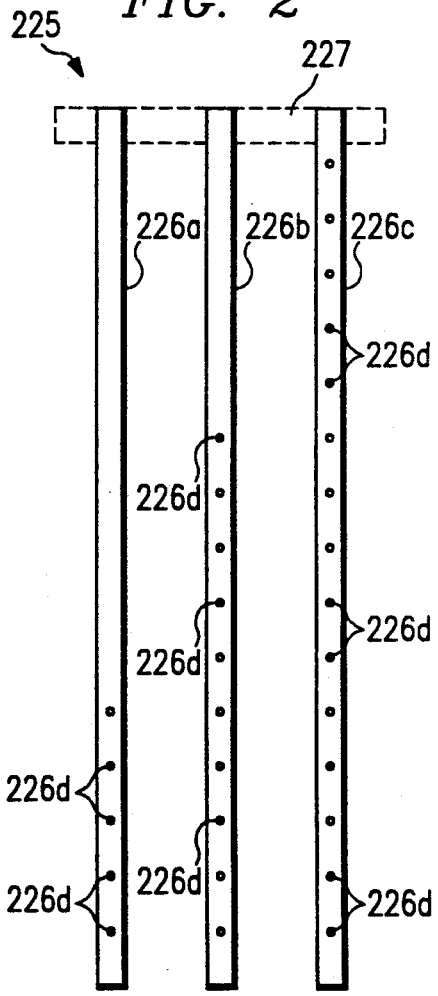
FIG. 2 is an elevational view of another embodiment of a shunt means which can be used in gravel packing apparatus of FIG. 1.

Shunt means 25 can be comprised of conduits having configurations and arrangements different from that shown in FIG. 1. For example, as shown in FIG. 2, shunt means 225 is comprised of a plurality of conduits 226*a–c* which have approximately the same length but each of which is perforated over different portions of its length. That is, conduit 226*c* has perforations 226*d* spaced over substantially its entire length while conduit 226*b* has perforations spaced over a lesser length and conduit 226*a* has perforations over even a lesser length.

Figure 3:
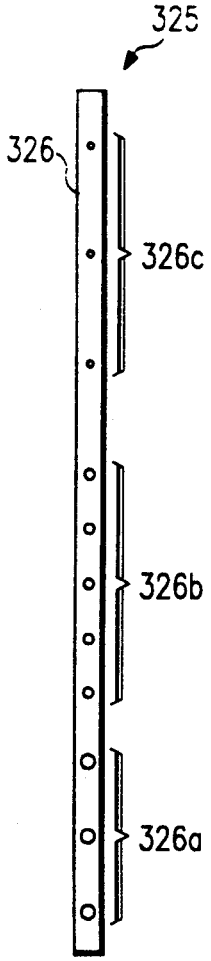
FIG. 3 is an elevational view of still another embodiment of a shunt means of the present invention.

FIG. 3 illustrates a shunt means 325 in accordance with the present invention which is comprised of at least one conduit 326 which has perforations spaced over substantially its entire length wherein the sizes (diameter) of the perforations vary from one end to the other. That is, conduit 326 has perforations 326*a* at one end which are relatively large (e.g. ⅛ inch diameter), intermediate perforations 326*b* which are smaller (e.g. 3/32 inch diameter), and still smaller perforations 326*c* (e.g. 1/16 inch diameter) at the other end. During a gravel pack operation, the gravel slurry will take the path of least resistance through the conduits and will tend to flow through the bigger perforations first until they become blocked and then will flow through the next larger perforations which remain open and so forth.

Figure 4:
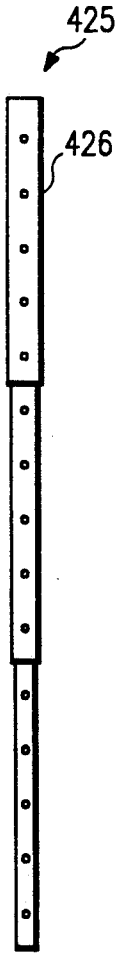
FIG. 4 is an elevational view of still another embodiment of a shunt means of the present invention.

FIG. 4 discloses still another shunt means 425 which is comprised of at least one stair-stepped conduit 426 which has a larger diameter at one end than the other.

Figure 5A:
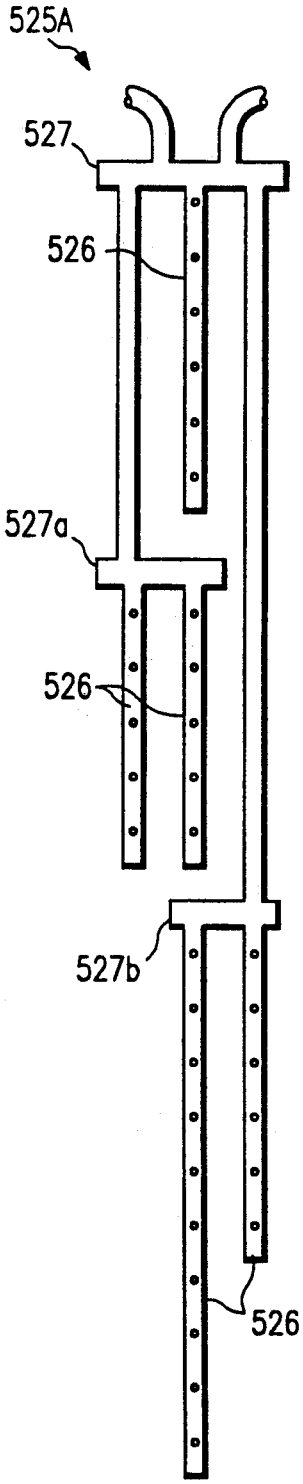
FIGS. 5A and 5B are elevational views of different manifolded arrangements of shunt means of the present invention.
Figure 5B:
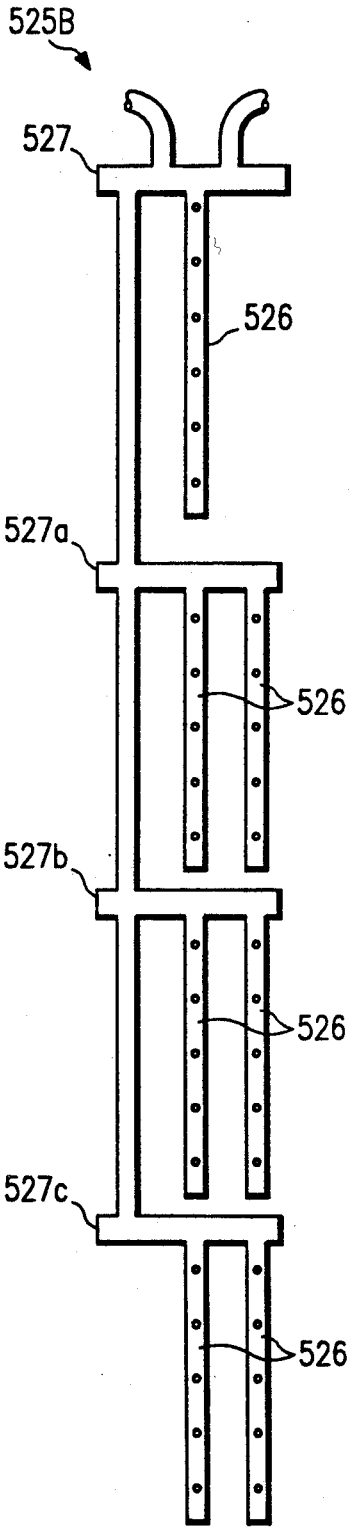

The larger diameter conduit at top encourages the slurry to flow downward in the conduit until gravel in the annulus blocks the perforations in the smaller diameter conduit. This shunt is particularly useful in circulation gravel packs since there is less screen area exposed through which liquid from the slurry can be lost and accordingly less chance for bridging in the annulus. FIGS. 5A and 5B both disclose shunt means 525*a* and 525*b*, respectively, which comprise different manifolding arrangements of conduits 526. In both shunt means, at least one conduit 526 is manifolded into a first manifold 527 which is adapted to be connected to outlet ports 28 (FIG. 1). The first manifold is connected to a second manifold 527*a* which, in turn, has a plurality of conduits 226 connected thereto. If desired, the second manifold can be further connected to a third manifold 527*b* (FIG. 5A) and a fourth manifold 527*c* (FIG. 5B) and so forth. These arrangements selectively deliver the gravel slurry directly to their respective levels in the annulus.

While the perforations in the conduits of the various shunt means have been shown as opening to the front of the conduits, it should be understood that that they could open laterally just as well. Further, the conduits do not have to have a circular cross-section but could be square, retangular, or other configuration.

What is claimed is:

1. Apparatus for gravel packing an interval of a wellbore, said apparatus comprising:

a sand screen adapted to be connected to the lower end of a workstring; and shunt means on the external surface of said sand screen for selectively delivering a gravel slurry to different levels of said interval when said apparatus is in an operable position within said wellbore.

2. The apparatus of claim 1 wherein said shunt means comprises:

a plurality of perforated conduits extending longitudinally along said external surface of said screen, at least one of said conduits being shorter than the others.

3. The apparatus of claim 1 wherein said shunt means comprises:

a plurality of conduits extending longitudinally along said external surface of said screen, each of said conduits having perforations extending along a length of said conduit which is different from the perforated lengths of the others of said conduits.

4. The apparatus of claim 1 wherein said shunt means comprises:

at least one conduit extending longitudinally along said external surface of said screen, said conduit having perforations substantially throughout its length wherein said perforations are larger at one end than at the other end.

5. The apparatus of claim 1 wherein said shunt means comprises:

at least one conduit extending longitudinally along said external surface of said screen, said conduit having perforations substantially throughout its length and having a diameter larger at one end than at the other end.

6. The apparatus of claim 1 including:

a cross-over sub connected to the upper end of said screen, said cross-over sub having outlet ports therein; and means for fluidly connecting said outlet ports to said shunt means whereby fluids flowing through said outlet ports will flow directly into said shunt means.

7. The apparatus of claim 6 wherein said shunt means comprises:

a plurality of perforated conduits extending longitudinally along said external surface of said screen; and said connecting means comprises:

a first manifold connected to each of said conduits and having inlet means connected to said outlet ports.

8. The apparatus of claim 7 including:

a second manifold fluidly connected to said first manifold; and plurality of perforated conduits fluidly connected to said second manifold.

* * * * *